US005308376A

United States Patent [19]

Oskarsson

[11] Patent Number: 5,308,376

[45] Date of Patent: May 3, 1994

[54] CERMET HAVING DIFFERENT TYPES OF DUPLEX HARD CONSTITUENTS OF A CORE AND RIM STRUCTURE IN A CO AND/OR NI MATRIX

[75] Inventor: Rolf Oskarsson, Ronninge, Sweden

[73] Assignee: Sandvik AB, Sandviken, Sweden

[21] Appl. No.: 543,474

[22] Filed: Jun. 26, 1990

[30] Foreign Application Priority Data

Jun. 26, 1989 [SE] Sweden ..... 8902306

[51] Int. Cl.[5] ..... C22C 29/04; C22C 29/08; C22C 29/10

[52] U.S. Cl. ..... 75/238; 85/230; 85/233; 85/234; 85/235; 85/236; 85/237; 85/239; 85/240; 85/241; 85/242; 85/244; 85/248

[58] Field of Search ..... 75/230, 233, 234, 235, 75/236, 237, 238, 239, 240, 241, 242, 244, 248

[56] References Cited

U.S. PATENT DOCUMENTS 4,857,108 8/1989 Brandt et al. ..... 75/238
4,885,132 12/1989 Brandt et al. ..... 419/15
4,944,800 7/1990 Kolaska et al. ..... 75/238
4,957,548 9/1990 Shima et al. ..... 75/238
4,985,070 1/1991 Kitamura et al. ..... 75/238
5,149,595 9/1992 Kojo et al. ..... 428/552

FOREIGN PATENT DOCUMENTS 63-216941 9/1988 Japan .

*Primary Examiner*—Donald P. Walsh
*Assistant Examiner*—Daniel Jenkins
*Attorney, Agent, or Firm*—Burns, Doane, Swecker & Mathis

[57] ABSTRACT

A cermet in which the hard constituents are based on Ti, Zr, Hf, V, Nb, Ta, Cr, Mo and/or W and the binder phase is based on Co and/or Ni and possibly small amounts of Al being present. At least 80% by volume of the hard constituents consist of duplex structures made up of a core and at least one surrounding rim. The duplex hard constituents consist of several, preferably at least two, different hard constituent types concerning the composition of core and/or rim(s). These individual hard constituent types consist each of 10–80%, preferably 20–70% by volume of the total content of hard constituents. In addition, non-duplex hard constituents may be present in amounts of up to 20% by volume of the total hard constituent amount.

35 Claims, 1 Drawing Sheet

CERMET HAVING DIFFERENT TYPES OF DUPLEX HARD CONSTITUENTS OF A CORE AND RIM STRUCTURE IN A CO AND/OR NI MATRIX

FIELD OF THE INVENTION

The present invention relates to a sintered carbonitride alloy with titanium as a main component and well balanced amounts and distributions of other metallic alloying elements and carbon and nitrogen in order to give a good balance between wear resistance, toughness and resistance to plastic deformation. This is obtained by suitable combinations of various duplex hard constituents.

BACKGROUND OF THE INVENTION

Classic cemented carbide, i.e., based upon tungsten carbide (WC) and with cobalt (Co) as binder phase has in the last few years met with increased competition from titanium based hard materials, usually named cermets. In the beginning these titanium based alloys were used only for high speed finishing because of their extraordinary wear resistance at high cutting temperatures. This depended essentially upon the good chemical stability of these titanium based alloys. The toughness behaviour and resistance to plastic deformation were not satisfactory, however, and therefore the area of application was relatively limited.

The development has, however, proceeded and the range of application for sintered titanium based hard materials has been considerably enlarged. The toughness behaviour and the resistance to plastic deformation have been considerably improved. This has been done, however, by partly sacrificing the wear resistance.

An important development of titanium based hard alloys is substitution of carbon by nitrogen in the hard constituents. This decreases, i.e., the grain size of the hard constituents in the sintered alloy which, i.e., leads to the possibility of increasing the toughness at unchanged wear resistance. These alloys are usually considerably more fine grained than normal cemented carbide, i.e., WC-Co-based hard alloy. Nitrides are also generally more chemically stable than carbides and these result in lower tendencies to sticking of work piece material or wear by solution of the tool, so called diffusional wear.

In the binder phase, the metals of the iron group, i.e., Fe, Ni and/or Co, are used. In the beginning only Ni was used, but nowadays both Co and Ni are often found in the binder phase of modern alloys.

Besides Ti, the other metals of the groups IVa, Va and VIa, i.e., Zr, Hf, V, Nb, Ta, Cr, Mo and/or W, are normally used as hard constituent formers. There are also other metals used, for example Al, which sometimes are said to harden the binder phase and sometimes improve the wetting between hard constituents and binder phase, i.e., facilitate the sintering.

Most papers, patent publications, etc. relating to sintered carbonitride alloys deal with the hard constituents as a homogeneous phase independent of how many alloying components are involved. This is natural because normally only one type of reflexes is obtained from hard constituents at X-ray diffraction analyses of such alloys. In order for deeper understanding of the often very complex sintered titanium-based carbonitride alloys it is necessary, however, to penetrate the structure more in detail.

It is a general opinion that alloys of this type are always in equilibrium. There are, however, about as many small local equilibriums as the number of hard constituent grains in the alloy. It is evident by way of a more careful examination that the hard constituent grains most often are duplex, usually still more complicated, in the shape of a core and at least one surrounding rim having a different composition. The surrounding rims have within themselves no constant compositions but often contain various gradients at which, for example, a metal content can decrease towards the center, which is compensated for by another metal content which decreases towards the surface. Also, the relative contents of the interstitial elements carbon and nitrogen vary more or less continuously from the center of the hard constituent grains and out to the surface in contact with the binder phase.

U.S. Pat. No. 3,971,656 discloses the preparation of a duplex hard constituent in which the core has a high content of titanium and nitrogen and the surrounding rim has a lower content of these two elements which is compensated for by higher amounts of group VIa-metals, i.e., principally molybdenum and tungsten, and of a higher content of carbon. The higher contents of Mo, W and C have, i.e., the advantage that the wetting to the binder phase is improved, i.e., the sintering is facilitated.

In Swedish Patent Application No. 8604971-5, it is shown how the resistance to plastic deformation can be considerably improved by the carbide phase of the alloy having a duplex structure in which the core has a high content of titanium and tantalum but a low content of nitrogen. The surrounding rim has a higher amount of group VIa-atoms, i.e., molybdenum and tungsten, and a higher nitrogen content than the core, i.e., the distribution of nitrogen is contrary to that of U.S. Pat. No. 3,971,656. In comparison with sintered carbonitride alloys having the same macroscopic compositions but prepared from elementary raw materials (which caused structures of the type described above), a considerably better resistance to plastic deformation was obtained with materials containing duplex carbonitride having a low nitrogen content in the core according to the invention being referred to.

U.S. Pat. No. 4,778,521 relates to carbonitrides with a core containing high amounts of Ti, C and N, an intermediary rim having high amounts of W and C and an outer rim containing Ti, W, C and N in contents between those in the core and those in the intermediary rim, respectively.

Another variation of the same subject is shown in Japanese Patent Application No. 63-216,941 in which the core consists of (Ti, Ta/Nb) (C,N) and the rim of (Ti, Ta/Nb, W/Mo) (C,N). The raw material is the carbonitride of the core and the process is the same as in the previously mentioned patent, i.e., the raw materials with W and Mo are dissolved and are present in the rim which grows on remaining hard constituent grains during the sintering. Also, this type of carbonitride gives an improved toughness at unchanged wear resistance.

It is common in all of the above-mentioned patents and patent applications that they only relate to one type of carbonitride in each sintered alloy and that they have lower contents of group VIa-metals in the core than in the rim/rims.

In German DE 38 06 602 Al is described how the hot strength properties can be improved by giving a raw material in the form of complex carbide and/or nitride a diffusion impeding barrier layer in the beginning of the sintering process, i.e., when the binder phase starts melting, by means of an aluminum containing complex carbide and/or nitride in the raw materials. This is an example of how it is possible by means of so-called "amalgam metallurgy" to isolate cores which otherwise would have been dissolved to some extent. The improved properties are only related to the amount of added $Ti_2AlN$.

SUMMARY OF THE INVENTION

The present invention relates to sintered carbonitride alloys with the separate hard constituent grains built of a core and one or more concentric rims or surrounding layers of another composition. In each sintered carbonitride alloy there are well balanced amounts of at least two types of individual hard constituent grains. The invention particularly relates to hard constituents having higher contents of tungsten and/or molybdenum in the core than in the rim/rims as well as to several different types of carbonitrides in the same sintered alloy.

DETAILED DESCRIPTION OF THE PREFERRED EMBODIMENTS

Figure 1:
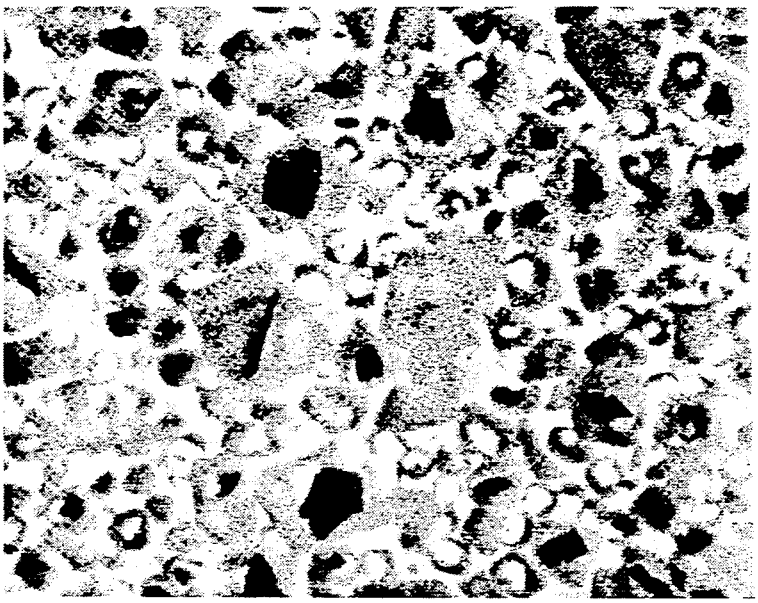
FIG. 1 shows the microstructure of a sintered carbonitride alloy according to the invention.

The present invention relates to sintered carbonitride alloys with the separate hard constituent grains built of a core and one or more concentric rims or surrounding layers of another composition. In each sintered carbonitride alloy there are well balanced amounts of at least two types of individual hard constituent grains. The invention particularly relates to hard constituents having higher contents of tungsten and/or molybdenum in the core than in the rim/rims as well as to several different types of carbonitrides in the same sintered alloy.

It has been found that a high amount of W and/or Mo in the core with an accompanying high content of carbon, results in an increased wear resistance, but with the toughness behaviour somewhat impaired. By balancing the hard constituent grains of the type high Ti(C,N) in the core, high Mo, W and low N in the rim or rims, the toughness behaviour is improved and by means of hard constituent grains of type high Ti, Ta, low N in the core and high W, Mo, high N in the rim/rims the resistance to deformation is improved. All types of hard constituents have besides their positive properties also less satisfactory properties being at least inferior to those of other hard constituents. The words "high" and "low", respectively, concerning contents of various elements mean higher and lower contents of the elements just being compared within the same hard constituent grain. Any graduating between different types of hard constituents is not possible but all relates to relative contents.

Titanium and tantalum hard constituents are more chemically stable than, for example, molybdenum and tungsten hard constituents. Thus, it is often difficult to get tungsten-and molybdenum-rich cores. The situation in relation to pure hard constituents can be improved by using (Ti,W)C or even (Ti,W)(C,N) instead of pure WC. The grains can be larger by using larger grains of said component as raw material in the milling or adding the component first at the end of the milling when the main milling of the other components has already been done.

Examples of various types of duplex carbonitrides are given in Table 1 below:

TABLE 1

| Hard Constituent Type | Core | Rim(s) |
|---|---|---|
| A | High Ti, N<br>Low W, Mo | High W, Mo<br>Low N |
| B | High Ti, Ta<br>Low N | High W, Mo<br>High N |
| C | High W, Mo<br>Low Ti | Low W, Mo<br>High Ti |
| D | Pure TiN | The other metallic alloying elements |

It can be suitable to describe the structure of the hard constituents by means of the formula $(Ti,Zr,Hf,V,Nb,Ta)_x(Cr,Mo,W)_y(C,N)_z$ in which $Ti+Zr+Hf+V+Nb+Ta=1$ $Cr+Mo+W=1$ $C+N=1$ $x+y=1$ $z$=stoichiometric parameter In the formula the nitride formers, i.e., the elements of groups IVa and Va, have been separately grouped and the carbide formers, i.e., the elements of group VIa, have been separately collected. All of the nine types of atoms can be present in the same carbonitride hard constituent. Also, within each hard constituent grain several gradients can occur. The stoichiometry in the rim(s) does not need to be the same at portions thereof adjacent the core as at portions thereof in contact with the binder phase. This also applies to intermediary rims.

According to the invention, it is possible by selection of various raw materials and manufacturing parameters to permutate all of the nine types of atoms so that any of them can have a greater concentration in the core than in the rim(s) or vice versa. In the same way, carbon and nitrogen can be influenced by suitable selection of carbides, nitrides and/or carbonitrides as raw materials. As carbides, nitrides and carbonitrides are also meant mixed raw materials, i.e., one or more metals may be present, for example (Ti,W)C, (Ti,Ta)(C,N), etc. Ta can partly or completely be replaced by Nb and to a certain extent by V. Cr may be present as a certain part of W and/or Mo.

As raw materials, pure metals or alloys can also be used. The hard constituents are in this case formed in situ by nitriding in a nitrogen containing gas mixture, by carbonitriding in a gas mixture containing both nitrogen and carbon and/or by reaction with elementary carbon added to the powder mixtures.

As pointed out earlier, the mentioned patents have only related to one dominating type of carbonitride in the sintered alloy. By leaving said principle of domination and combining hard constituent grains with different properties, great advantages can be obtained. According to the invention, the various hard constituent types can be present in 10–80%, preferably 20–70% by volume of the hard constituent part in order to give the desired combination of properties. Besides the main types of hard constituents, which should be at least two in number, other kinds of hard constituents of a more secondary nature may also be present in amounts of up to 20, preferably up to 10% by volume.

It has been found that the material according to the invention is also suitable for making a macro-gradients in a sintered body, i.e., differences of composition and hard constituents between surface zone and center. By this procedure different desired combinations of wear resistance and toughness behaviour can be further influenced.

The following examples are for purposes of understanding the invention, it being understood that same are intended only as illustrative and in nowise limitative.

EXAMPLE 1

A sintered carbonitride alloy with 14% by weight Co+Ni - binder phase was made according to the invention with two duplex raw materials besides the conventional ones. In the obtained alloy, 90% by volume of the hard constituents consisted of two main types of duplex hard constituents, such as 40% by volume of titanium-rich cores and 60% by volume of tungsten- and molybdenum-rich cores, the latter ones also containing a higher amount of tantalum. FIG. 1 shows the structure having relatively large grains with a dark core, i.e., enriched in light elements such as titanium but essentially missing heavy elements such as tungsten, and also having small grains with light cores, i.e., enriched in heavy elements. Table 2 gives the average composition and the composition of dark cores, light cores and rim(s) obtained at an integrated macro-analysis, normalized to the above presented formula, $(Ti,Ta,V)_x(Mo,W)_y(C,N)_z$.

TABLE 2

| | Ti | Ta | V | x | Mo | W | y | C | N | z |
|---|---|---|---|---|---|---|---|---|---|---|
| Average | 0.89 | 0.03 | 0.07 | 0.82 | 0.48 | 0.52 | 0.18 | 0.77 | 0.23 | 0.98 |
| Dark Cores | 0.96 | 0.01 | 0.03 | 0.95 | 0.47 | 0.53 | 0.05 | 0.70 | 0.30 | 0.90 |
| Light Cores | 0.84 | 0.04 | 0.12 | 0.75 | 0.45 | 0.55 | 0.25 | 0.84 | 0.16 | 0.86 |
| Rim(s) | 0.92 | 0.03 | 0.06 | 0.85 | 0.46 | 0.54 | 0.15 | 0.80 | 0.20 | 0.85 |

EXAMPLE 2

Figure 2:
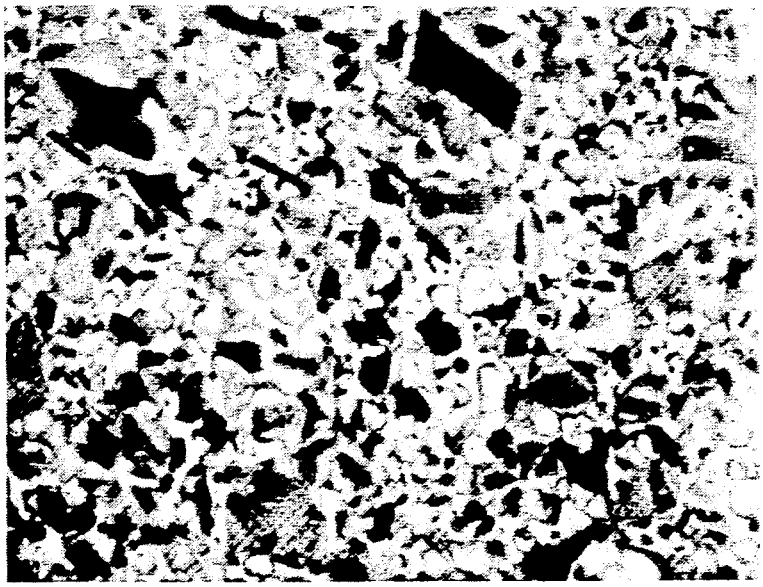
FIG. 2 shows the microstructure of another sintered carbonitride alloy according to the invention.

Another sintered carbonitride alloy with 16% by weight Co+Ni - binder phase was made in the same way as in Example 1 but using other duplex raw materials: Ti(C,N) with another C/N -ratio and Ti+Ta - raw material with another Ti/Ta - ratio. The obtained material contained three different types of cores with associated rim(s) and less than 10% by volume of non-duplex hard constituents. The cores have been named white, gray and dark, respectively, and the amounts thereof were 40%, 20% and 40% by volume, respectively. See FIG. 2.

Table 3 shows the average composition in % by weight regarding the metal content of the three different types of cores with associated rim(s) normalized to about 100%, i.e., the interstitial content is not shown (carbon, oxygen, and/or nitrogen).

TABLE 2

| | Ti | Ta | V | x | Mo | W | y | C | N | z |
|---|---|---|---|---|---|---|---|---|---|---|
| Average | 0.89 | 0.03 | 0.07 | 0.82 | 0.48 | 0.52 | 0.18 | 0.77 | 0.23 | 0.98 |
| Dark Cores | 0.96 | 0.01 | 0.03 | 0.95 | 0.47 | 0.53 | 0.05 | 0.70 | 0.30 | 0.90 |
| Light Cores | 0.84 | 0.04 | 0.12 | 0.75 | 0.45 | 0.55 | 0.25 | 0.84 | 0.16 | 0.86 |
| Rim(s) | 0.92 | 0.03 | 0.06 | 0.85 | 0.46 | 0.54 | 0.15 | 0.80 | 0.20 | 0.85 |

While the invention has been described with reference to the foregoing embodiments, various modifications, substitutions, ommissions, and changes may be made thereto without departing from the spirit thereof. Accordingly, it is intended that the scope of the present invention be limited solely by the scope of the following claims, including equivalents thereof.

What is claimed is:

1. A cermet comprising hard constituents selected from the group consisting of Ti, Zr, Hf, V, Nb, Ta, Cr, Mo, W, carbides, nitrides, carbonitrides and mixtures thereof and a binder phase selected from the group consisting of Co, Ni and mixtures thereof, at least 80% by volume of the hard constituents consisting of duplex structures comprising a core and at least one rim surrounding the core, the duplex hard constituents consisting of at least two different types of said hard constituents, each of the different types of said duplex hard constituents having compositional ratios or ingredients in the core, rim(s) or core and rim(s) which differ from those of other types of the duplex hard constituents and each of the different types of said duplex hard constituents being present in amounts of 10–80% by volume of a total amount of the hard constituents.

2. The cermet according to claim 1, wherein one of the duplex hard constituents consists of a core with high W- and low Ti- contents and rim(s) with lower W- and higher Ti- contents relative to the core.

3. The cermet according to claim 1, wherein one of the duplex hard constituents consists of a core with high Ta- and low W- contents and rim(s) with lower Ta- and higher W- contents relative to the core.

4. The cermet according to claim 1, wherein one of the duplex hard constituents consists of a core with high W- and low Ti- contents and rim(s) with lower W- and higher Ti- contents relative to the core and another one of the duplex hard constituents consists of a core with high Ta- and low W- contents and rim(s) with lower Ta- and higher W- contents relative to the core.

5. The cermet according to claim 2, wherein W is partly substituted by Mo.

6. The cermet according to claim 3, wherein Ta is partly substituted by V.

7. The cermet according to claim 1, wherein each of the hard constituents is present in amounts of 20–70% by volume of the total amount of the hard constituents.

8. The cermet according to claim 5, wherein up to 50% by weight of W is substituted by Mo.

9. The cermet of claim 1, wherein one of the duplex hard constituents has Ti-base cores.

10. The cermet of claim 9, wherein another one of the duplex hard constituents has W-base, Mo-base or W+Mo-base cores.

11. The cermet of claim 9, wherein the duplex hard constituents have Ti-base cores and Ti-base rims.

12. A cermet comprising hard constituents and a binder phase, the binder phase comprising at least one of Ni and Co, the hard constituents including optional first non-duplex hard constituents including at least one compositional ingredient selected from the group consisting of Ti, Zr, Hf, V, Nb, Ta, Cr, Mo and W and a nonoptional second hard constituents including at least one compositional ingredient selected from the group consisting of Ti, Zr, Hf, V, Nb, Ta, Cr, Mo, W, carbides, nitrides, carbonitrides and mixtures thereof, the second hard constituents being present in amounts of at least 80% by volume of a total amount of the hard constituents, each of said second hard constitutents having a duplex structure of a core and at least one rim surrounding the core, the second hard constituents including first duplex grains and second duplex grains, the first duplex grains being different in compositional ratios or ingredients in the core, the rim or the core and the rim than the second duplex grains.

13. The cermet of claim 12, wherein the first duplex grains are present in amounts of 10 to 80% by volume of a total amount of the hard constituents.

14. The cermet of claim 13, wherein the second duplex grains are present in amounts of 10 to 80% by volume of a total amount of the hard constituents.

15. The cermet of claim 12, wherein the cores of the first duplex grains include high W and low Ti contents compared to respective W and Ti contents in the rims of said first duplex grains.

16. The cermet of claim 15, wherein the cores of the first duplex grains include high Ta and low W contents compared to respective Ta and W contents in the rims of said first duplex grains.

17. The cermet of claim 15, wherein the cores of the second duplex grains include high Ta and low W contents compared to respective Ta and W contents in the rims of said second duplex grains.

18. The cermet of claim 12, wherein the cores of the first duplex grains include high W compared to the rims of said first duplex grains.

19. The cermet of claim 18, wherein Mo is substituted for up to 50% of the W.

20. The cermet of claim 18, wherein V is substituted for up to 50% of the W.

21. The cermet of claim 12, wherein the cores of the first duplex grains include low W compared to the rims of said first duplex grains.

22. The cermet of claim 12, wherein the cores of the first duplex grains include high Ti contents compared to Ti contents in the rims of said first duplex grains.

23. The cermet of claim 22, wherein the cores of the first duplex grains further include low Mo, low W and high N compared to respective Mo, W and N contents in the rims of said first duplex grains.

24. The cermet of claim 22, wherein the cores of the first duplex grains further include high Ta and low N compared to respective Ta and N contents in the rims of said first duplex grains.

25. The cermet of claim 12, wherein the cores of the first duplex grains include high W, high Mo contents compared to respective W, Mo contents in the rims of said first duplex grains.

26. The cermet of claim 18, wherein at least part of the W is replaced with Cr.

27. The cermet of claim 12, wherein the cores of the first duplex grains include high Ti compared to Ti contents in the rims of the first duplex grains and the cores of the second duplex grains include high W and high Mo compared to respective W and Mo contents in the rims of the second duplex grains.

28. The cermet of claim 12, wherein the cores of the first duplex grains include at least one of low Ti, high Mo, low Ta, high W and high V compared to respective Ti, Mo, Ta, W and V contents in the rims of the first duplex grains and the cores of the second duplex grains include at least one of high Ti, low Mo, high Ta, low W and low V compared to respective Ti Mo, Ta, W and V contents in the rims of the second duplex grains.

29. The cermet of claim 12, wherein the cores of the first duplex grains include at least one of high Ti, low Mo, high Ta, low W and low V compared to respective Ti, Mo, Ta, W and V contents in the rims of the first duplex grains and the cores of the second duplex grains include at least one of high Ti, low Mo, low Ta, low W and low V compared to respective Ti, Mo, Ta, W and V contents in the rims of the second duplex grains.

30. The cermet of claim 12, wherein the cores of the first duplex grains include at least one of high Ti, low Mo, low Ta, low W and low V compared to respective Ti, Mo, Ta, W and V contents in the rims of the first duplex grains and the cores of the second duplex grains include at least one of low Ti, high Mo, low Ta, high W and high V compared to respective Ti, Mo, Ta, W and V contents in the rims of the second duplex grains.

31. The cermet of claim 12, wherein the first duplex grains have Ti-base cores.

32. The cermet of claim 31, wherein the second duplex grains have Ti-base cores.

33. The cermet of claim 31, wherein the first and second duplex grains have Ti-base cores and Ti-base rims.

34. The cermet of claim 31, wherein the second duplex grains have W-base, Mo-base or W+Mo-base cores.

35. The cermet of claim 32, wherein the second hard constitutents include third duplex grains having W-base, Mo-base or W+Mo-base cores.

* * * * *